United States Patent [19]

Fujimoto et al.

[11] Patent Number: 4,606,403

[45] Date of Patent: Aug. 19, 1986

[54] APPARATUS AND METHOD FOR CLEANING CONDENSER TUBES OF A REFRIGERATOR

[75] Inventors: Masakazu Fujimoto; Naoyuki Inoue, both of Tokyo, Japan

[73] Assignee: Ebara Corporation, Japan

[21] Appl. No.: 691,535

[22] Filed: Jan. 15, 1985

[51] Int. Cl.[4] ..... F28F 27/00

[52] U.S. Cl. ..... 165/95; 15/3.51; 15/104.2; 62/505

[58] Field of Search ..... 15/104.2, 3.51; 165/95; 62/303, 505; 134/8

[56] References Cited

U.S. PATENT DOCUMENTS

| | | | |
|---|---|---|---|
| 3,146,605 | 9/1964 | Rachfal et al. | 62/505 X |
| 3,805,547 | 4/1974 | Eber | 62/505 |
| 4,418,747 | 12/1983 | Baron et al. | 165/95 |
| 4,508,164 | 4/1985 | Baron | 165/95 |

*Primary Examiner*—Lloyd L. King

*Attorney, Agent, or Firm*—Steinberg & Raskin

[57] ABSTRACT

In a refrigerator of a compression type or an absorption type, including a condenser and an evaporator, an apparatus for cleaning condenser tubes in which a cleaning brush movably mounted in each tube is moved through the tube by reversing a flow of cooling fluid therethrough so that the inner wall of the tube can be cleaned by the moving cleaning brush. Switching means switches from a temperature control means which controls refrigeration capacity depending upon temperature of a cooling and heating medium within the evaporator during the refrigeration operation, to control by pressure restriction means which restricts the pressure within the condenser to not exceed a predetermined value, before the flow of the cooling fluid in the tube is changed for cleaning the tube. When the inner pressure of the condenser is lowered at least by a fixed value from the predetermined value, the flow of cooling fluid may be changed within the condenser without changing from the temperature control to the pressure restriction control. Method for cleaning the condenser tubes of a refrigerator in this fashion is also provided.

13 Claims, 5 Drawing Figures

APPARATUS AND METHOD FOR CLEANING CONDENSER TUBES OF A REFRIGERATOR

BACKGROUND OF THE INVENTION

The present invention relates to an apparatus and method for cleaning condenser tubes as well as absorber tubes, within a refrigerator of the absorption type or in a compression type refrigerator having a centrifugal or a screw compressor.

In conventional apparatus and methods for cleaning condenser tubes of a refrigerator having a condenser and an evaporator, a cleaning brush is movably mounted within each respective tube that has chambers for capturing the cleaning brush at the opposite ends thereof. Thus the cleaning brush resides in one or the other of these oppositely-disposed chambers during normal operation of the refrigerator. When the tubes are to be cleaned, the cleaning brush is moved through the tube by reversing the flow of fluid such as cooling water therethrough. This is carried out by altering the flow path of the fluid such as cooling water by means of a flow path change valve, so that the inner wall of the tube can be cleaned by the moving cleaning brush.

However, in these conventional cleaning apparatus and methods, a period of time arises in which the amount or the rate of the cooling water flow is slight or non-existent, when the flow of the same is reversed during the cleaning operation. In this period, the pressure within the condenser rises, resulting in a high pressure trip or an overload of a motor depending upon the loading condition, or a surging phenomenon within the centrifugal compressor, together with the occurrence of noises and vibrations, all being disadvantageous effects.

FIG. 1, illustrates conditions during 100% operation of a conventional turbo refrigerator utilizing Freon 11 (trade name) as the refrigerant, when the flow path of the cooling water is changed.

In a conventional refrigerator, a temperature controller for controlling a cooling and heating medium such as a cooling water and a brine within the evaporator is provided, which controls refrigeration capacity depending upon a temperature signal representing a temperature detected within the cooling and heating medium during the refrigeration operation.

In order to eliminate such defects within conventional cleaning apparatus and processes, the timing for changing the flow path of the cooling water is advanced, or actuated when the load is low or the refrigerator is stopped. However, even when the timing for changing the flow path is advanced, the period inevitably arises where the flow amount or rate of the cooling water is slight or non-existent. Therefore, it is extremely difficult, if not impossible, to eliminate the aforementioned disadvantages.

Furthermore, while changing the cooling water flow direction through the condenser tubes during the period of low loading or stands still of the refrigerator might help to alleviate the above-noted problems, the cleaning operation naturally can not then be conducted at fixed intervals or at desired times. Thus, this just results in an undesirably smaller cleaning effect.

SUMMARY OF THE INVENTION

Accordingly, it is an object of the present invention to provide an apparatus and method for cleaning condenser tubes within a refrigerator, eliminating the above-noted disadvantages.

It is also an object of the present invention to provide for feasible cleaning of condenser tubes within a refrigerator at any fixed or conveniently desired time.

It is another object of the present invention to provide for feasible, effective cleaning of condenser tubes within a refrigerator without unwanted pressure build-up occurring within the condenser.

It is also another object of the present invention to minimize or totally eliminate noise and vibrations and unwanted surging that occur during the cleaning of condenser tubes within a refrigerator.

It is a further object of the present invention to provide for effective control of pressure within the condenser of a refrigerator, so that such pressure will not exceed a predetermined, fixed value.

It is even a further object of the present invention to provide for smooth, steady refrigeration, with minimal interruption thereof during a cleaning operation of tubes within the refrigerator.

These and other objects are attained by the present invention which in one aspect is directed to an apparatus for cleaning condenser tubes of a refrigerator including a condenser and an evaporator, wherein a cleaning brush is movably mounted within each respective tube and is moved therethrough by reversing flow of fluid such as cooling water through the tube so that an inner wall of each tube will be cleaned by the respective moving cleaning brush. Means for controlling the temperature of a cooling and heating medium in the evaporator is also provided, to control the refrigeration capacity depending upon a temperature of the cooling and heating medium within the evaporator, during the refrigeration operation.

The improvement of the present invention in this aspect comprises pressure restriction means for restricting an internal pressure of the condenser so as not to exceed a predetermined value, and also switching means which selectively actuates control by either the temperature control means or by the pressure restricting means, wherein the control by the temperature control means is switched over to the control by the pressure restricting means before the flow of the cooling water through the condenser tubes is changed for cleaning the same. Thus the internal pressure of the condenser is controlled to not exceed the predetermined value, during the cleaning of the tubes therein.

In another aspect, the present invention is directed to a method of cleaning tubes within a refrigerator, such as condenser tubes mounted within a condenser therein, in which a cleaning brush is movably mounted within each respective condenser tube. This is accomplished by controlling the internal pressure within the condenser, and then reversing the flow of fluid through the condenser tubes after the internal pressure of the condenser has been so controlled.

BRIEF DESCRIPTION OF THE DRAWINGS

Other objects, features, and advantages of the present invention will become apparent from the following description in further detail below, with reference to the accompanying drawings, in which.

DETAILED DESCRIPTION OF THE PREFERRED EMBODIMENTS

Figure 1:
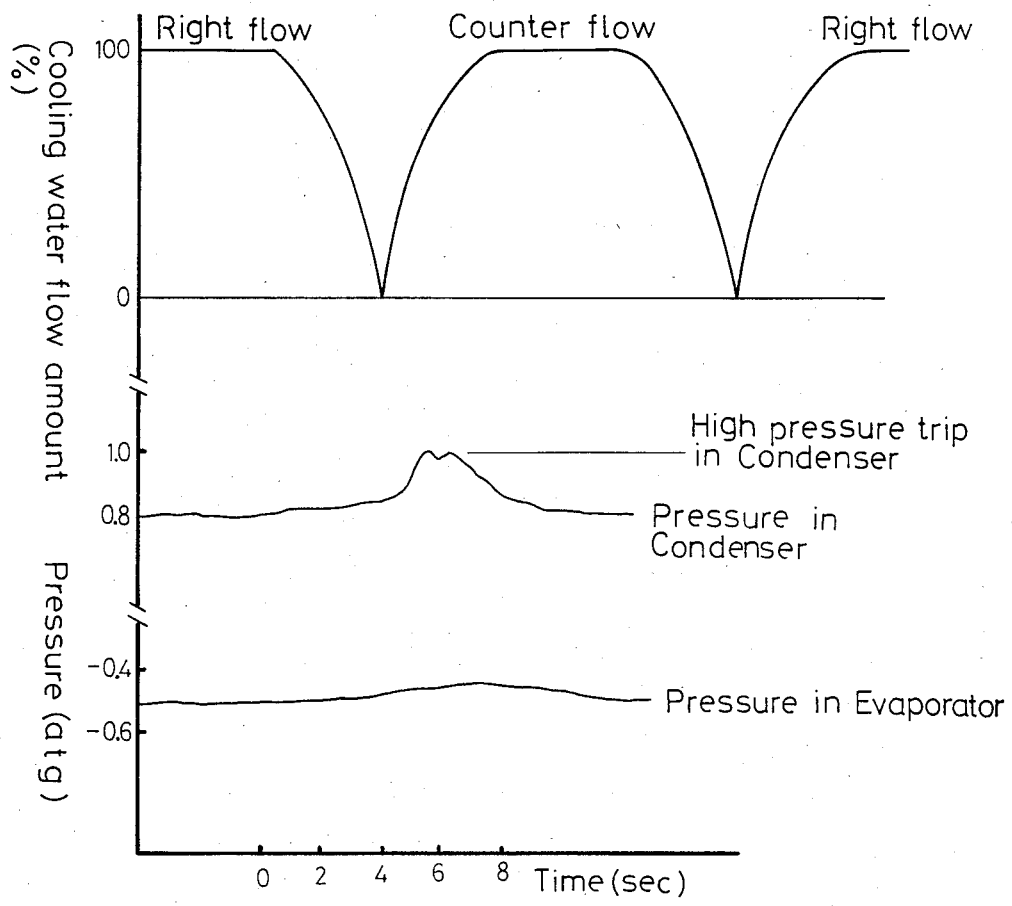
FIG. 1 is a graphical representation illustrating various conditions at the time of the change of a flow path of fluid such as cooling water through condenser tubes in a condenser of a conventional refrigerating apparatus and method.
Figure 2:
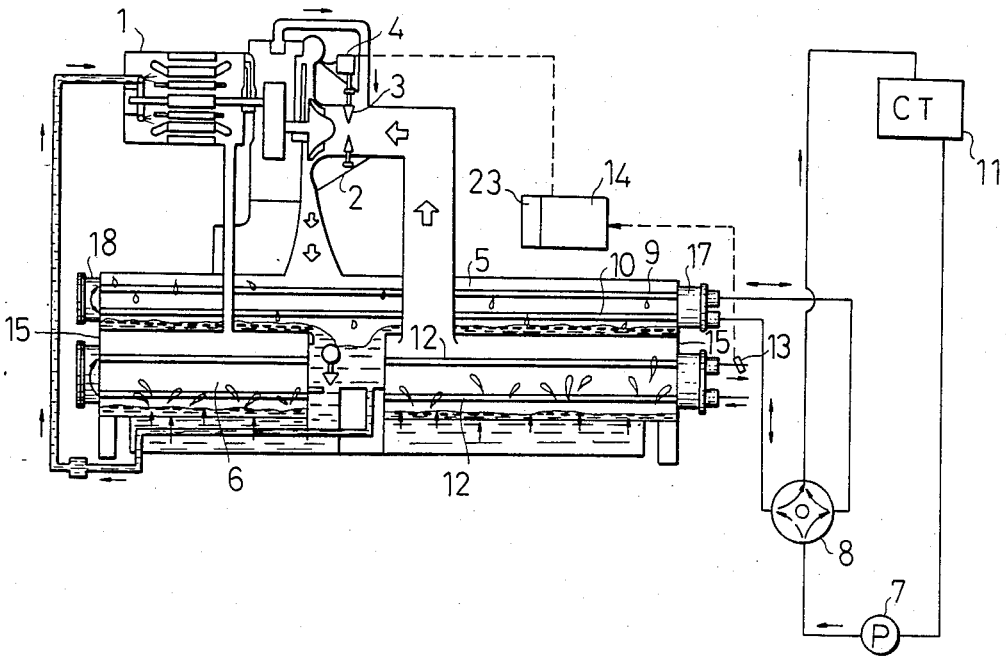
FIG. 2 is a partially schematic, vertical sectional view of one embodiment of an apparatus and method for cleaning condenser tubes of a refrigerator according to the present invention.

Referring to the drawings, where similar or corresponding components are designated by like reference numerals throughout the different figures, one embodiment of an apparatus and method for cleaning condenser tubes of a refrigerator is illustrated in FIG. 2.

As illustrated in FIG. 2, a motor 1 drives a compressor 2 of a centrifugal type, with a suction vane 3 being provided for controlling an inspirational amount of fluid at an inlet of the compressor 2. The suction vane 3 is controlled by a vane motor 4. A condenser 5 and an evaporator 6 are cooperatively coupled to one another, i.e. the condenser 5 is coupled onto the evaporator 6. Fluid such as cooling water is supplied to a tube 9 or 10 within the condenser 5, via a four-way valve 8 by a pump 7. The cooling water is then passed out of the tube 9 or 10 to a cooling tower 11 via the four-way valve 8, while the cooling water condenses a refrigerant vapor to liquify the same within the condenser 5. The cooling water cooled within the cooling tower 11 is then fed to the pump 7.

A fluid to be cooled such as water or brine, is supplied to the tubes 12 within the evaporator 6 and serves as a cooling and heating medium. This water or brine evaporates the refrigerant liquid within the evaporator 6 as the water or brine flows through the tubes 12 therein, with the water or brine thereby being cooled at the same time by the latent heat of vaporization of the refrigerant liquid. In the illustrated embodiment, the evaporator 6 operates as a cooler.

The compressor 2 inspires the refrigerant vapor from the evaporator 6 through the suction vane 3, and discharges compressed refrigerant vapor into the condenser 5. The condensed refrigerant within the condenser 5 is then passed to the evaporator 6 via a float chamber and a float valve. A portion of the condensed refrigerant is circulated from the evaporator 6 to the motor 1 for cooling, through a conduit which is splayed into the motor 1 as illustrated, and then is passed back to the evaporator 6 via another conduit after having cooled the motor 1.

The temperature of the thus-cooled water or brine discharged from the tube 12 of the evaporator 6 is detected by a temperature detector 13. The temperature detector 13 is connected to a controller 14 which controls the temperature of the cooling and heating medium such as the water or brine, and which controls refrigeration capacity by using a temperature signal sent from the temperature detector 13. The controller 14 sends a control signal the vane motor 4 in order to control the vane 3, thereby controlling the refrigeration capacity. The vane motor 4 controls the suction vane 3 as a capacity valve, depending upon the control signal received, so that the temperature of the cool water or brine at the outlet of the tube 12 from the evaporator 6, may attain a predetermined value.

Switching means 23 is coupled with the controller 14. This switching means 23 changes the functions of the controller 14, i.e. the function as the temperature control device for the cooling and heating medium such as the cool water and brine within the evaporator tubes 12 as described above, and the function as a pressure restriction device for controlling the internal pressure of the condenser 5, to not exceed a predetermined value, as described below.

The cleaning operation will no be described with reference to FIG. 3, which illustrates one individual condenser tube 9. This condenser tube 9 is mounted to tube plates 15 at opposite ends thereof, and a cleaning brush 16 is movably inserted into the tube 9. The opposite ends of the tube 9 open into liquid chambers 17 and 18 respectively, as illustrated in FIG. 2. A pair of chambers 19 and 20 for capturing the cleaning brush 16 are mounted at the opposite ends of the tube 9, to project into the liquid chambers 17 and 18 respectively, as illustrated. The chambers 19 and 20 are provided with openings 21 and 22 respectively, through which the cooling water can flow to and from the respective liquid chambers 17 and 18.

Figure 3:
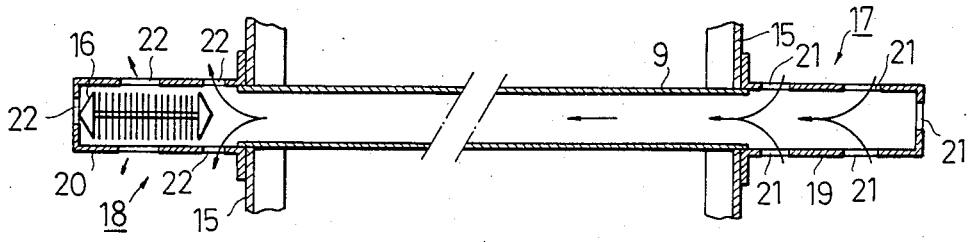
FIG. 3 is a fragmentary longitudinal sectional view of a condenser tube illustrated in FIG. 1.

During the refrigeration operation, the four-way valve 8 is positioned in one position as illustrated by the solid lines in FIG. 2, and the cooling water flows in the leftward direction through the tube 9, as illustrated by the arrows in FIG. 3. Therefore, the cooling water flowing through the tube 9 pushes the cleaning brush 16 to the left, so that the brush 16 is captured within the left-hand side chamber 20.

When the tube 9 is to be cleaned, the four-way valve 8 is turned to another position as illustrated by the broken lines in FIG. 2, so that the flow of the cooling water within the tube 9 is reversed towards the right side thereof. Then, the cleaning brush 16 is pushed by the water flowing in the opposite direction to move in the rightward direction through the tube 9, resulting in the cleaning brush being captured in the right-hand side chamber 19. While the cleaning brush 16 is moving through the tube 9, the inner wall of the tube 9 is cleaned by the moving cleaning brush. Such a flow path change or alteration is conducted at proper intervals by turning the four-way valve 8, to thereby clean the condenser tubes 9 and 10.

Figure 4:
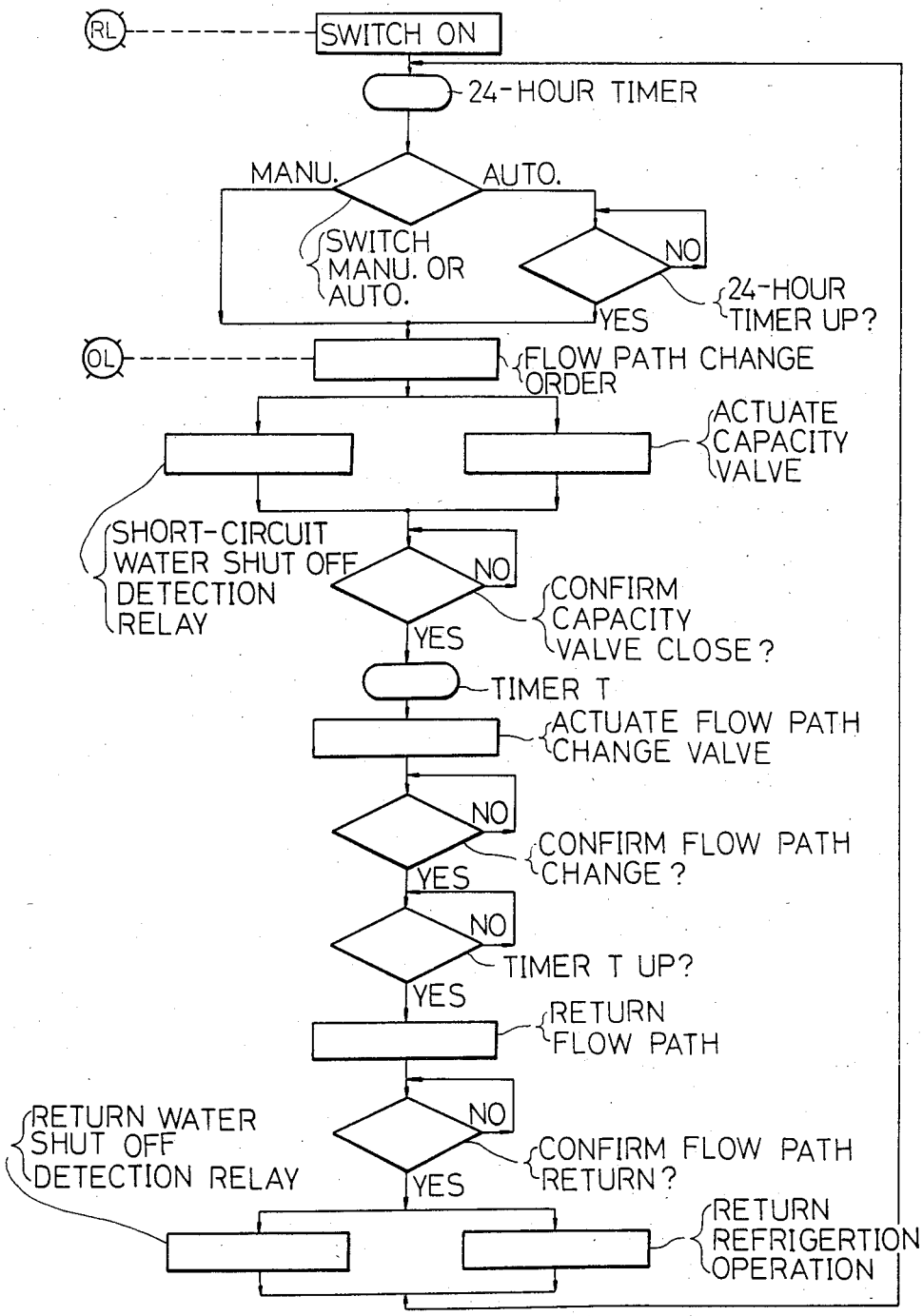
FIG. 4 is a schematic flow diagram for controlling pressure within a condenser, according to the present invention.

On beginning the cleaning of the tubes, in order to prevent an extraordinary rise in the pressure in the condenser 5 beyond the predetermined value, which is caused by changing the flow path of the cooling water as noted, the cleaning operation is carried out by an order illustrated in the accompanying flow diagram of FIG. 4.

Referring to FIG. 4, a twenty-four hour timer or the like is used as the switching means 23, with the time for changing the flow path being predetermined by this timer, e.g. every eight hours or three times a day. Therefore, the cleaning operation will be automatically performed at regular intervals.

The controller 14 which normally functions as the temperature control device for the cooling and heating medium such as the water and the brine within the evaporator tubes 12, thus controlling the refrigeration capacity by detecting the temperature of the water or brine, is switched to operate as the pressure restriction device, in preference to the temperature control device, by the switching means 23 when cleaning the tubes 9 and 10.

Then, the controller 14 sends a control signal to the vane motor 4 for reducing refrigeration capacity by reducing the inspirational amount of refrigerant supplied to the compressor 2. Then, the vane motor 4 controls the suction vane 3 as a capacity valve to close the same either completely or to a predetermined minimum open amount. In other words, refrigeration capacity is controlled by the controller 14 as the pressure restriction device, in proportion to the amount of refrigerant inspired by the compressor 2. In this situation, the controller 14 functioning as the pressure restriction device results in lower refrigeration capacity as compared to the functioning as the temperature control device during the overall refrigeration operation, as described above. Thus it is quite clear that alteration in the direction of the cooling water through the condenser tubes 9 and 10 may be then conducted, after it has been determined that the refrigeration capacity is nonexistent or has reached the predetermined minimum level.

When a screw-type compressor is used, a slide vane is opened completely or to a predetermined maximum level, in order to determine that the refrigeration capacity is nonexistent or has reached the predetermined minimum amount.

The operation for changing the flow path of the cooling water through the condenser tubes 9 and 10 is completed in little time, in order to minimize influence on the burden or loads. Thus, this alteration in the flow path is completed within ten seconds, in the particular embodiment.

The refrigerator illustrated in FIG. 2 is provided with a water shut-off detectional relay (not illustrated) which is a type of safety device for stopping operation of the refrigerator of FIG. 2 when the flow of the cooling water through the tubes 9 and 10 is shut-off or stops completely, or becomes nonexistent, in order to prevent breaking down of the refrigerator.

Therefore, in general, when the flow path of the cooling water is altered, the flow of the cooling water inevitably stops or becomes nonexistent, and thus the water shut-off detection relay is actuated, which results in stopping the operation of the refrigerator itself. Therefore, according to the present invention, during the operation of altering the flow path of the cooling water through the condenser tubes 9 and 10, it is necessary to disable the water shut-off detection relay. This disabling is performed by short-circuiting the water shut-off detection relay before the flow path is changed, as illustrated in the schematic diagram of FIG. 4.

A short interval timer T is used for stabilizing the flow system of the fluid before changing the flow thereof to the return direction, as illustrated in FIG. 4. A red colored lamp RL is switched on when the refrigerator is operated, while an orange colored lamp OL is switched on when the time of the twenty-four hour timer is up for conducting the tube cleaning, i.e. when the order for changing the flow path is performed. The orange colored lamp is switched off when the flow path is returned to the original direction, i.e. when the cleaning of the tubes is completed.

As described above, the controller 14 is switched from the temperature control device to the pressure restriction device by the switching means 23, when cleaning the tubes. This results in a lower refrigeration capacity as compared with the refrigeration capacity resulted by the temperature control device during the normal operation. However, such a lower refrigeration capacity can be obtained by controlling the compressor to reduce its rotational speed. In other words, the refrigeration capacity may be controlled in proportion to the rotational speed of the compressor in a rotation-type of refrigerator.

Figure 5:
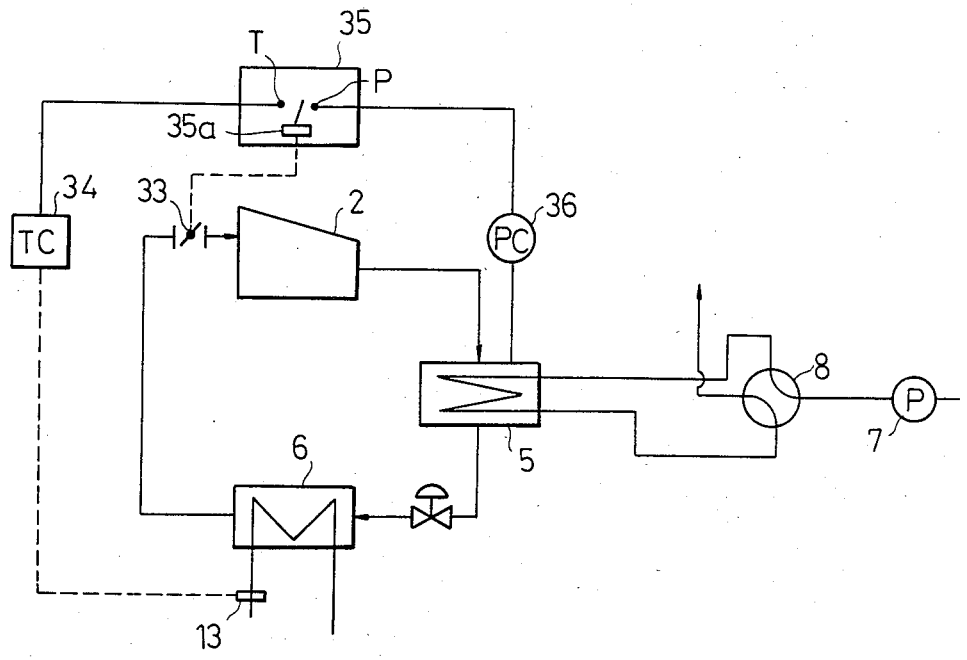
FIG. 5 is a flow diagram of another embodiment of an apparatus and method for cleaning condenser tubes of a refrigerator according to the present invention.

Another embodiment of the apparatus and method of the present invention for cleaning condenser tubes of a refrigerator is illustrated in FIG. 5. This illustrated embodiment has a similar structure to the first embodiment illustrated in FIG. 2, and thus description of the same or similar parts having the same reference numerals have been omitted for the sake of brevity.

In the embodiment illustrated in FIG. 5, a compressor 2 inspires a refrigerant vapor from an evaporator 6 through a capacity valve 33, and discharges a thus-compressed refrigerant vapor to a condenser 5. A temperature detector 13 detects the temperature of the water or brine at the outlet of the evaporator tubes 12 within the evaporator 6, and then transmits a temperature signal to a temperature control means 34, for controlling a cooling and heating medium such as water or brine, to a predetermined temperature value.

The temperature control means 34 receives the temperature signal from the temperature detector 13 and transmits a control signal for controlling the capacity valve 33, to switching means 35. A common contact point 35*a* of the switching means 35 is connected to the capacity valve 33.

Pressure restriction means 36 for restricting the internal pressure within the condenser 5 in order not to exceed a predetermined value, detects the internal pressure within the condenser 5 and outputs a control signal for controlling the capacity valve 33, to the switching means 35.

When the internal pressure within the condenser 5 is below the predetermined value, the common contact point 35*a* of the switching means 35 leads to a contact point T which is in turn connected to the temperature control means 34, thereby conducting the temperature control of the cool water or brine within the evaporator tubes 12, by the temperature control means 34. When the internal pressure within the condenser 5 is above the predetermined value, then the common contact point 35*a* of the switching means 35 leads to a contact point P which is connected to the pressure restriction means 36, thereby conducting the pressure restriction control of the condenser 5 by the pressure restriction means 36, to prevent any extraordinary rise of the internal pressure within the condenser 5.

According to the present invention, it is possible for the pressure restriction means 36 to detect the temperature within the condenser 5 and then control the capacity valve 33 depending upon the detected temperature therein in order not to exceed a predetermined temperature level, thereby controlling internal pressure within the condenser 5 to remain below the predetermined value.

When a pressure or temperature which is obtained by detection within the condenser 5 preceding the cleaning of the tubes is then lowered by at least a fixed amount from the predetermined value, it may become unnecessary to switch over from the temperature control to the pressure restriction control. In other words, it may be possible to change the flow path of the cooling water through the condenser tubes 9 and 10 without switching over from the temperature control to the pressure restriction control, because, even when a high pressure trip occurs in the condenser 5, the inner pressure within the condenser 5 cannot exceed the predetermined value.

Although the invention has been explained with reference to preferred embodiments of a compression-type refrigerator, the present invention may be also applied to an absorption-type refrigerator. In this instance, components such as an absorber (means for absorbing a refrigerant gas), a solution pump (means for transferring to a high pressure portion), and a generator (means for generation of a refrigerant gas) correspond to the compressor on the refrigeration cycle in the absorption-type refrigerator.

The present invention can be applied to the absorber and to the condenser having the tubes for the cooling liquid such as water within the absorption-type refrigerator, with the same results as those attained with compression-type refrigerators according to the present invention.

In the above description of the preferred embodiments, the term "condenser" also includes an absorber of an absorption-type refrigerator.

Although the present invention has been described with reference to preferred embodiments thereof illustrated in the accompanying drawings, it is quite clear to one of skill in the art that various changes and modifications can be made without departing from the scope of the present invention.

What is claimed is:

1. In an apparatus for cleaning at least one condenser tube of a refrigerator including a condenser in which the at least one tube is disposed and an evaporator, wherein a cleaning brush movably mounted within the at least one tube is moved therethrough by reversing a flow of fluid such as cooling liquid therethrough, so that an inner wall of the tube is cleaned by the moving cleaning brush, and wherein temperature control means for a cooling and heating medium in the evaporator controls refrigeration capacity depending upon temperature of the cooling and heating medium during the refrigeration operation, the improvement comprising pressure restriction means for restricting internal pressure of the condenser to not exceed a predetermined value, and switching means for selectively actuating the temperature control means or said pressure restriction means, said switching means switching control from the temperature control means over to said pressure restriction means before flow of the fluid through the at least one condenser tube is changed for cleaning thereof, whereby the internal pressure of the condenser is controlled to not exceed the predetermined value.

2. The combination of claim 1, wherein said pressure restricting means constitutes means for controlling the refrigeration capacity to be lower than the refrigeration capacity controlled by the temperature control means

3. The combination of claim 2, wherein said pressure restricting means constitutes means for controlling the refrigeration capacity in proportion to an amount of a refrigerant inspired by a compressor, in a compression-type refrigerator.

4. The combination of claim 2, wherein said pressure restricting means constitutes means for controlling the refrigeration capacity in proportion to rotation speed of a compressor, in a rotation-type refrigerator.

5. The combination of claim 1, wherein said pressure restricting means constitutes means for controlling the refrigeration capacity according to pressure detected within the condenser.

6. The combination of claim 1, wherein said pressure restricting means constitutes means for controlling the refrigeration capacity according to temperature detected within the condenser.

7. The combination of claim 1, additionally comprising means for lowering the internal pressure of the condenser by a fixed amount from the predetermined value, whereby control by the temperature control means is maintained during the reversal of the fluid flow through the at least one condenser tube for cleaning the same.

8. The combination of claim 7, wherein said means for lowering the internal pressure of the condenser constitutes means for lowering the same in response to pressur detected within the condenser.

9. The combination of claim 7, wherein said means for lowering the internal pressure of the condenser constitutes means for lowering the same in response to temperature detected within the condenser.

10. In an apparatus for cleaning at least one condenser tube of a refrigerator including a condenser in which the at least one tube is disposed and an evaporator, wherein a cleaning brush movably mounted in the at least one tube is moved therethrough by reversing a direction of flow of fluid such as cooling liquid therethrough, so that an inner wall of the tube is cleaned, and wherein means for controlling temperature of a cooling and heating medium in the evaporator controls refrigeration capacity according to temperature of the cooling and heating medium during the refrigeration operation, the improvement comprising means for restricting an internal pressure of the condenser to not exceed a predetermined value, and means for selectively actuating said restricting means and the temperature controlling means, said restricting means being actuated before the direction of the flow of the fluid through the at least one condensing tube is changed.

11. The combination of claim 1, additionally comprising a compressor for inspiring refrigerant vapor from the evaporator into the condenser, a suction vane disposed within the compressor through which the refrigerant vapor is inspired, and wherein said pressure restricting means constitutes means for closing said suction vane completely or by a predetermined amount.

12. The combination of claim 5, additionally comprising a compressor for inspiring refrigerant vapor from the evaporator into the condenser, a capacity valve disposed within the compressor through which the refrigerant vapor is inspired, and wherein said pressure restricting means constitutes means for controlling said capacity valve.

13. The combination of claim 2, wherein said pressure restricting means constitutes means for restricting internal pressure within an absorber to not exceed a predetermined value.

* * * * *